US006669894B2

(12) United States Patent
Choi et al.

(10) Patent No.: US 6,669,894 B2
(45) Date of Patent: Dec. 30, 2003

(54) ROASTER WITH STABILIZED FLUIDIZED BED FOR ROASTING ZINC CONCENTRATE

(75) Inventors: Chang-Young Choi, Seoul (KR); Young-Gae Chun, Ulsan-Shi (KR)

(73) Assignee: Korea Zinc Co., Ltd. (KR)

( * ) Notice: Subject to any disclaimer, the term of this patent is extended or adjusted under 35 U.S.C. 154(b) by 91 days.

(21) Appl. No.: 10/052,969

(22) Filed: Jan. 18, 2002

(65) Prior Publication Data

US 2003/0122289 A1 Jul. 3, 2003

(30) Foreign Application Priority Data

Dec. 1, 2001 (KR) ..... 2001-0075701

(51) Int. Cl.[7] ..... C22B 1/10
(52) U.S. Cl. ..... 266/172; 432/58
(58) Field of Search ..... 266/172; 432/58

(56) References Cited

U.S. PATENT DOCUMENTS 2,475,607 A * 7/1949 Garbo ..... 432/58
2,855,287 A * 10/1958 Cyr ..... 432/58
5,785,733 A * 7/1998 Lee et al. ..... 266/172
6,241,801 B1 * 6/2001 Kepplinger et al. ..... 266/172

FOREIGN PATENT DOCUMENTS

JP 352115704 A * 9/1977

* cited by examiner

*Primary Examiner*—Scott Kastler
(74) *Attorney, Agent, or Firm*—Cooper & Dunham LLP

(57) ABSTRACT

Disclosed is a fluidized bed roaster with stabilized fluidized bed for roasting zinc concentrate which can have a uniform internal temperature distribution to form a stabilized fluidized bed, thereby dramatically reducing the amount of sulfide sulfur contained in calcine and the amount of fine calcine particle carried over to a gas discharge port.

2 Claims, 3 Drawing Sheets

ROASTER WITH STABILIZED FLUIDIZED BED FOR ROASTING ZINC CONCENTRATE

BACKGROUND OF THE INVENTION

1. Field of the Invention

The present invention relates to a roaster with a stabilized fluidized bed for roasting zinc concentrate, and more particularly to a fluidized bed roaster for zinc concentrate which forms a stabilized fluidized bed to reduce the content of sulfide sulfur, produced due to incomplete desulfurization of zinc concentrate, in calcine produced by the roasting of zinc concentrate.

2. Description of the Related Art

As well known to those skilled in the art, the so-called roasting is a process for converting metal ores to their oxides by heating the ores at a temperature below their melting point for the purpose of easily reducing the ores in a subsequent process. For example, in the case of iron ore, magnetite is roasted to generate hematite. Zinc concentrate (ZnS) is roasted to oxidize its sulfur component into sulfur dioxide, thereby producing zinc calcine (ZnO).

There are various types of roasters, which are furnaces used for the roasting process, and the roasters include, for example concerning zinc, a multiple hearth roaster, a flash roaster, a fluidized bed roaster, etc.

Although brands such as MacDougall Furnace, Herreshoff, Wedge, Skinner, etc. supply multiple hearth roasters, they are limited only to small-scale sulfuric acid factories but are not used in large-scale roasting process such as in a refinery. In the flash roaster, during the falling of ore particles dried by heating, most of combustible components of the ore particles are instantaneously oxidized. Accordingly, the ores have to contain sufficient combustible components to maintain the required temperature, and their particles should be sufficiently fine to be calcined thoroughly within the falling time of the particles. Owing to short contact time of ore particles with roasting gas, there are disadvantages in that it is required that ore particles should be milled sufficiently into fine particles and that the temperature of the roasting chamber should be maintained at a high enough temperature to finish the roasting within such a short contact time.

Fluidized bed roasters, to which the present invention relates are designed to allow ore particles and roasting gas to come into contact with each other for a sufficiently long time. Such fluidized bed roasters include a dry type and a wet type. In the dry type, dry ores containing about 10% moisture are fluidized to be roasted. In the wet type, wet ores (slurry) containing approximately 25% moisture are poured to be roasted.

As the dry type roaster for roasting zinc concentrate, there is LURGI-VM T.M, which was put to practical use in the latter half of the 1950's, and became popularized for commercial use between the 1960's and the 1970's. The roasting process in such a roaster involves the steps of blowing hot air into the roaster to increase the internal temperature of the roaster to a required temperature for roasting concentrate, supplying oxygen required for roasting zinc concentrate through an air supply port 4-1, while charging zinc concentrate through a concentrate charge port (not shown) arranged at one side of a lower cylindrical section 3-1, by which the zinc concentrate is exposed to oxidizing atmosphere to undergo an oxidation process. Because the oxidation is an exothermic reaction, further feeding of hot air is unnecessary to maintain the internal temperature of the roaster.

It is only necessary to regulate the amount of charged concentrate so as to control the internal temperature of the roaster. Zinc calcine (ZnO) oxidized from zinc concentrate (ZnS) by the roasting treatment is discharged through a calcine discharge port 8-1 and collected, which port is arranged at the other side of the lower cylindrical section 3-1 above the concentrate charge port.

Roasters used in the above-described process to roast zinc concentrate have been developed to be applicable to a specific zinc ore roasting method improvably modified from a conventional sulfide iron ore roasting method to meet the dissolution and electrolysis characteristics of zinc. A recent tendency is to pulverize zinc concentrate into fine particles at a mine to improve the grade and the recovery rate of zinc, in pace with improvements in mining technology. Such fine concentrate particles have a short residence time in conventional roasters for roasting zinc concentrate. Thus, unburned sulfide sulfur (hereinafter referred to as S.S.) increases in quantity. Also, the angle of repose, 7-1, of an intermediate tapered section 2-1 in the conventional roaster of FIG. 2 or 3 is limited to 20°, by which the space velocity of roasting gas is faster than the flow rate of the particles. As a result, a great quantity of roasted calcine is scattered around and carried over to the gas discharge port of the roaster, along with the gas. The carried-over calcine may be attached to the wall surface and tubes of a boiler, which is downstream processing equipment, thereby resulting in accelerated pressure loss and a contamination of gas purifying facilities. Therefore, it is difficult to achieve a continuous operation. Thus, there is a problem in that the yearly output and real yield of zinc decline.

SUMMARY OF THE INVENTION

Therefore, the present invention has been made in view of the above problems, and it is an object of the present invention to provide a fluidized bed roaster with a stabilized fluidized bed for roasting zinc concentrate, which can have a uniform internal temperature distribution to form a stabilized fluidized bed, thereby dramatically reducing the amount of sulfide sulfur contained in calcine and the amount of fine calcine particles carried over to a gas discharge port, while achieving an increase in productivity.

In accordance with the present invention, the above and other objects can be accomplished by the provision of a fluidized bed roaster for roasting zinc concentrate, comprising: an upper cylindrical section closed at an upper end thereof by a top circular roof fixedly mounted to the upper end, the upper cylindrical section having a volume corresponding to 3.8 to 4.8 times the volume of a lower cylindrical section; an intermediate tapered section fixedly coupled, at an upper end thereof, to a lower end of the upper cylindrical section, the intermediate tapered section having a structure downwardly tapered at a repose angle of 22 to 25° while having a volume corresponding to 1.7 to 2.2 times the volume of the lower cylindrical section; the lower cylindrical section fixedly coupled, at an upper end thereof, to a lower end of the intermediate tapered section; and an air supply port coupled to a lower end of the lower cylindrical section, the air supply port having tuyeres arranged in a density of 110 to 135 tuyeres per unit area ($m^2$).

Preferably, the tuyeres have a diameter of 5 to 5.8 mm and a pitch of 85 to 95 mm.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 2:
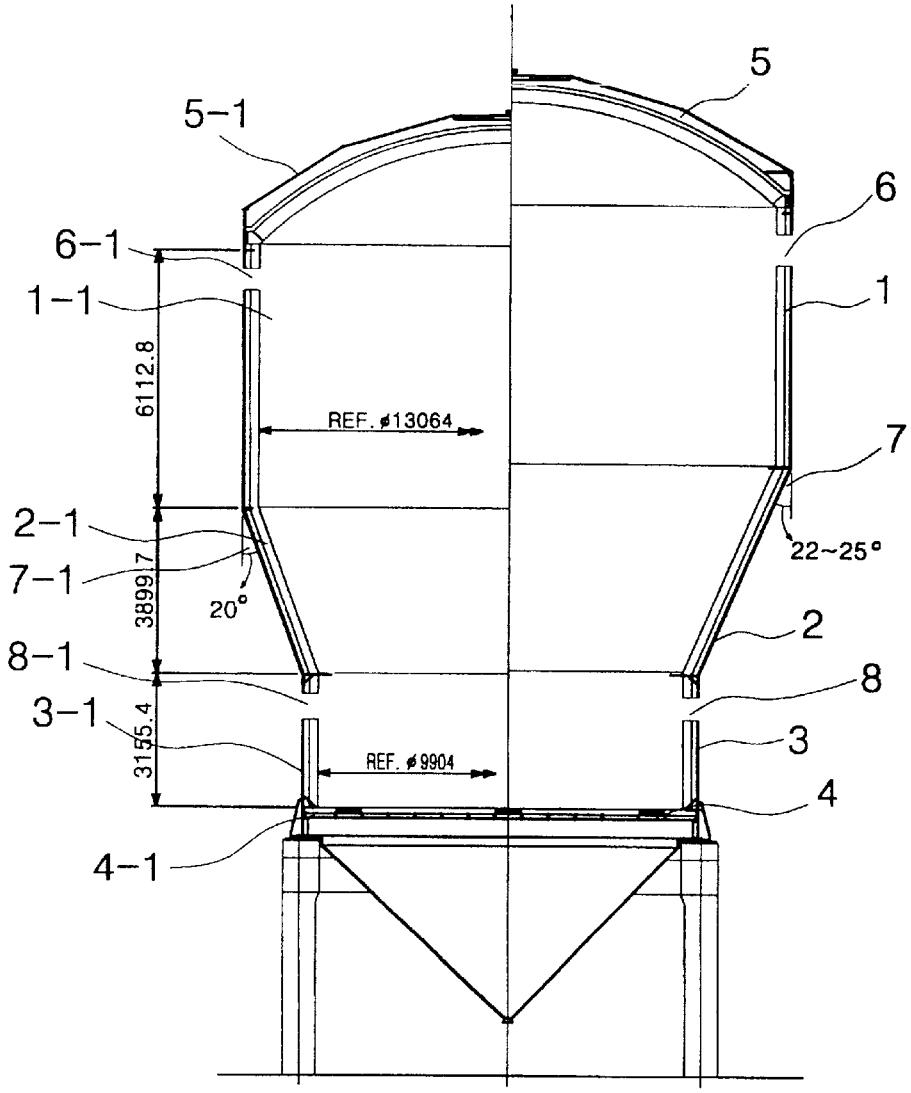
FIG. 2 is a schematic cross-sectional view partially illustrating both a fluidized bed roaster in accordance with an embodiment of the present invention and a conventional fluidized bed roaster, for the comparison of the roasters.
Figure 3:
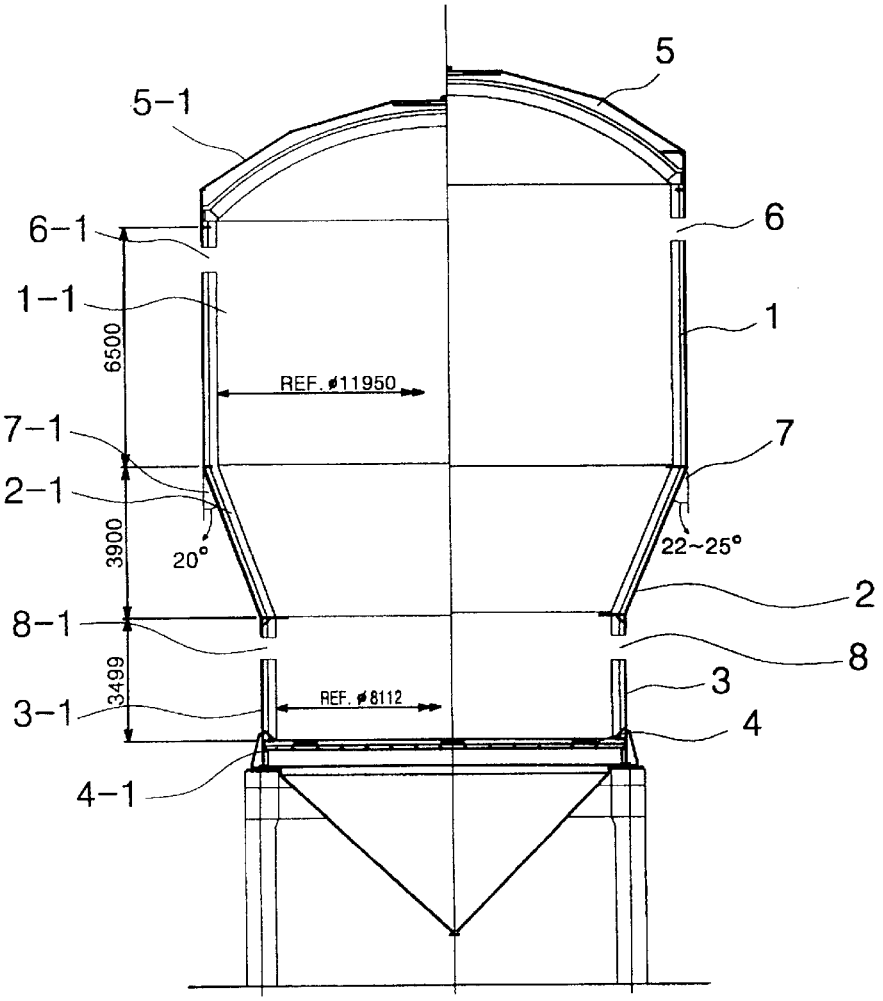
FIG. 3 is a schematic cross-sectional view partially illustrating both a fluidized bed roaster in accordance with another embodiment of the present invention and a conventional fluidized bed roaster, for the comparison of the roasters.

FIG. 2 is a schematic cross-sectional view partially illustrating both a fluidized bed roaster in accordance with an embodiment of the present invention and a conventional fluidized bed roaster, for the comparison of the roasters. FIG. 3 is a schematic cross-sectional view partially illustrating both a fluidized bed roaster in accordance with another embodiment of the present invention and a conventional fluidized bed roaster, for the comparison of the roasters.

As illustrated in the FIGS. 2 and 3, each of the conventional fluidized bed roasters includes an upper cylindrical section 1—1, a lower cylindrical section 3-1, and an intermediate tapered section 2-1 arranged between the upper and lower cylindrical sections 1—1 and 3-1. An air supply port 4-1, which includes a plurality of tuyeres, is arranged at the lower end of the lower cylindrical section 3-1 to upwardly inject air into the interior of the roaster, in order to allow concentrate continuously charged into the roaster to perform a reaction for combustion in a highly fluidized state. The roaster is designed to completely burn fine ore particles, incompletely burned by a fluidized bed in the lower cylindrical section 3-1, in the upper cylindrical section 1—1, thereby enabling a subsequent processing facility, for example, a boiler, to be operated satisfactorily.

However, as described in the above description of the related arts, in the conventional fluidized bed roaster for roasting zinc concentrate, fine concentrate particles have short residence time in the roaster, so that unburned sulfide sulfur increases in quantity. Also, the space velocity of roasting gas is fast in comparison with the flow rate of the particles, and thus a great quantity of roasted calcine is scattered around and carried over to the gas discharge port of the roaster, along with the gas. The carried-over calcine may be attached to the wall surface and tubes of the boiler, which is downstream processing equipment, thereby resulting in accelerated pressure loss and a contamination of gas purifying facilities. Therefore, it is difficult to achieve a continuous operation. Thus, there is a problem in that the yearly output and real yield of zinc decline.

In order to solve this problem, the present invention provides a fluidized bed roaster with a stabilized fluidized bed for roasting zinc concentrate. The fluidized bed roaster according to the present invention includes an upper cylindrical section 1, a lower cylindrical section 3, and an intermediate tapered section 2 arranged between the upper and lower cylindrical sections 1 and 3.

In accordance with the present invention, the upper cylindrical section 1 has an increased inner diameter and an increased height, as compared to the upper cylindrical section 1—1 of the conventional roaster. That is, the upper cylindrical section 1 has a volume corresponding to 3.8 to 4.8 times the volume of the lower cylindrical section 3 so that its volume is larger than the conventional roaster by about 10 to 40%.

The intermediate tapered section 2, which is connected, at an upper end thereof, to the lower end of the upper cylindrical section 1, has a tapered structure having an inner diameter identical to that of the upper cylindrical section at the upper end of the intermediate incline section 2 while being gradually reduced toward the lower end of the intermediate tapered section 2 in accordance with a repose angle of 22 to 25°. The intermediate tapered section 2 is also designed to have a volume corresponding to 1.7 to 2.2 times the volume of the lower cylindrical section 3. In accordance with these constructional conditions, it is possible to reduce the flow rate of a fine particle flow emerging from the fluidized bed in the lower cylindrical section 3. The lower cylindrical section 3, which is connected at an upper end thereof, to the intermediate tapered section 2, has an inner diameter identical to the inner diameter of the intermediate tapered section 2 at the lower end of the intermediate tapered section.

In addition, an air supply port 4 is arranged at the lower end of the lower cylindrical section 3. The air supply port 4 includes tuyeres of 110–135 in number per unit area ($m^2$). The tuyeres have a diameter of 5 to 5.8 mm, and a pitch of 85 to 95 mm, which are smaller than those used in the conventional roaster. As the smaller-diameter tuyeres are arranged more densely than those used in the conventional air supply port 4-1, it is possible to uniformly supply air while achieving an increase in air supply area.

The following Table 1 shows results of analysis carefully performed to determine the particle size distribution of each kind of ores.

TABLE 1

| Kinds of Ores | 325 Mesh (43 $\mu$m) | |
|---|---|---|
| M/I | 85~95 | FROM AUSTRALIA |
| B/H | 40~50 | FROM AUSTRALIA |
| Red Dog | 81~95 | FROM CANADA |
| Cannington | 85~92 | FROM AUSTRALIA |
| ELURA | 92~98 | FROM AUSTRALIA |
| GREENS CREEK | 90~96 | FROM U.S.A |
| GALMOY | 93~98 | FROM IRELAND |
| CENTURY | 97~99 | FROM AUSTRALIA |
| LARONDE | 80~89 | FROM CANADA |
| LENNARD SHELF | 60~70 | FROM AUSTRALIA |

* Analysis of particle size is based on a wet screening method.

All ore samples were obtained between 1978 and 2001, and the particle size of most of concentrate is −325 Mesh, considered as extremely fine, as described in the above description. Now, the fluidized bed roaster for zinc concentrate according to the present invention will be described in more detail with reference to examples according to the present invention.

EXAMPLE 1

In the conventional roaster "LURGI-ROASTER", zinc concentrates (ZnO) having different particle size distributions were roasted, respectively. The contents of total sulfur (T.S) and sulfide sulfur (S.S) in each calcine are summarized in Table 2.

TABLE 2

| Calcine | Particle Size of Concentrate Based on −325 Mesh | | | | | |
|---|---|---|---|---|---|---|
| | 90~95% | | 60~70% | | 40~50% | |
| | T.S | S.S | T.S | S.S | T.S | S.S |
| Overflow Calcine | 0.6 | 0.3 | 0.7 | 0.35 | 0.6 | 0.25 |
| Boiler Calcine | 3.2 | 0.8 | 2.8 | 0.46 | 2.0 | 0.35 |
| Cyclone Calcine | 3.3 | 0.9 | 3.0 | 0.47 | 2.8 | 0.3 |
| Dust EP Calcine | 7.5 | 0.2 | 6.0 | 0.10 | 4.0 | 0.05 |
| Total Calcine | 2.6 | 0.7 | 2.1 | 0.42 | 1.9 | 0.3 |

(unit: %)

Table 2 shows The results of an analysis carefully performed to determine the particle size distribution of calcine and the amount of sulfide sulfur contained in calcine in each equipment (boiler, cyclone, electric dry type dust collector, and Overflow). The results of Table 2 are averaged roasting results of a 54 $m^2$ roaster obtained over several years. Roasting conditions were almost constant, and the charge amount of ore was 7.8 $t/m^2 \cdot D$. Referring to Table 2, it can be seen that although there is a slight variation in the content of S.S according to the content of impurities in concentrate, Pb, Cu, $SiO_2$ and $H_2O$, the concentrate having a smaller particle size has an increased content of S.S. Especially, an increased amount of S.S is found in downstream processing facilities, that is, the boiler and cyclone.

The following Table 3 shows contents of S.S in zinc calcine obtained after concentrates having a particle size distribution of 90% of −325 mesh are roasted in roasters having different volumes, over about one year.

TABLE 3

| Total Calcine | ROASTER① | ROASTER② | ROASTER③ |
|---|---|---|---|
| S.S | 0.6~0.7 | 0.5~0.6 | 0.4~0.45 |

(unit: %)

The results of Table 3 were obtained under almost constant roasting conditions (temperature, airflow amount, wind box pressure, and $H_2O$ content) while using an ore charge amount of 8 $t/m^2 \cdot D$. All roasters have the same lower cylindrical section volume, that is, a volume of 270 $m^3$ while having different upper cylindrical section volumes as follows:

1) 910 $m^3$ in ROASTER① (conventional roaster)
2) 1,044 $m^3$ in ROASTER② (roaster① according to the invention)
3) 1,120 $m^3$ in ROASTER③ (another roaster ② according to the invention).

Referring to Table 3, it can be seen that when the volume of the upper cylindrical section is increased, the content of S.S is reduced. In each roaster of the present invention, optimal conditions are obtained when the volume of the upper cylindrical section is larger than that of the conventional roaster by 10 to 40%. Where the upper cylindrical section volume is increased above the above-defined range, economic benefits are reduced due to increased investment costs, while an expected increase in the content of S.S in the final product, that is, zinc calcine, is insignificant.

Accordingly, it is preferred that the volume of the upper cylindrical section 1 in the roaster of the present invention has a volume greater than that of the conventional roaster by 10 to 40%, while corresponding to 3.8 to 4.8 times the volume of the lower cylindrical section 3.

EXAMPLE 2

It is necessary to reduce the amount of zinc concentrate carried over to (discharged through) the upper gas discharge port 6 of the roaster. In this connection, the weight of zinc concentrate discharged through the upper gas discharge port of each of the roasters ① to ③ was analyzed. However, no significant difference was observed among the roasters ① to ③. To this end, in accordance with the present invention, the intermediate tapered section 2 is designed to have an average cross-sectional area greater than that of the conventional roaster by 5 to 20% in order to obtain a space velocity of 0.25 to 0.3 m/sec. Also, the intermediate tapered section 2 is designed to have a volume corresponding to about 1.7 to 2.2 times the volume of the lower cylindrical section 3.

Where the intermediate tapered section 2 has an average cross-sectional area greater than that of the conventional roaster by 5 to 20%, thereby obtaining a space velocity of 0.25 to 0.3 m/sec, it is possible to reduce the amount of zinc calcine particles carried over to the upper gas discharge port 6, in particular, zinc calcine particles having a particle size of 140 to 200 Mesh. Conventionally, such zinc calcine particles having a particle size of 140 to 200 Mesh, which are largely carried over, along with gas, to the boiler, are removed from the boiler.

It is possible to increase the average cross-sectional area of the intermediate tapered section 2 by about 5 to 20% over that of the conventional intermediate tapered section 2-1 by designing the intermediate tapered section 2 to have a repose angle of 22 to 25°.

Where the intermediate tapered section 2 has a repose angle of more than 25°, that is, it has an average cross-sectional area 20% greater than that of the convention roaster, zinc calcine may be stacked in an agglomerated state on the surface of the lower portion of the intermediate tapered section 2. As a result, the flowability of zinc concentrate may be degraded. In severe cases, agglomerates of zinc calcine may block the tuyeres of the air supply port 4.

TABLE 4

| Amount of Calcine | +140 Mesh | 140~200 Mesh | −200 Mesh |
|---|---|---|---|
| Overflow Calcine | 85 | 13 | 2 |
| Boiler Calcine | 5 | 50 | 45 |

(unit: %)
* The mesh of all data is based on Tyler Mesh, and the calcine screening method was carried out using a sieve.

Figure 1:
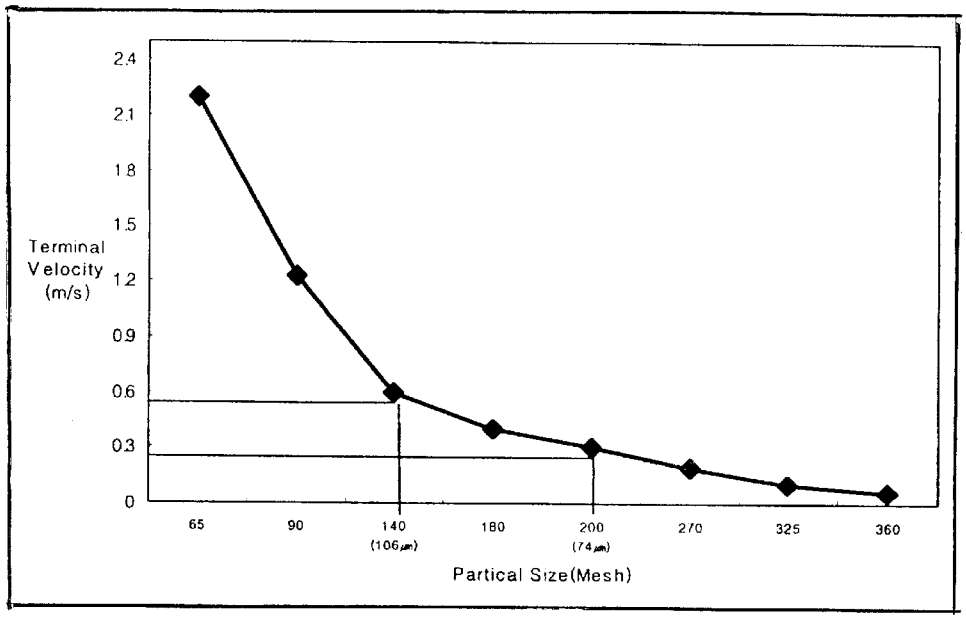
FIG. 1 is a graph showing the theoretical calculation results of the terminal velocity of zinc calcine particles while varying particle size.

Table 4 shows amounts of calcine distributed in respective subsequent processing facilities. The results are average values obtained after concentrates having a particle distribution of 90% for −325 mesh are roasted in a roaster, in which the intermediate tapered section 2 has an average cross-sectional area of 77 $m^2$. Theoretical terminal velocities of respective calcine particles under given roasting conditions can be estimated as shown in FIG. 1. Based on the collective results of Table 4 and FIG. 1, it can be understood that when the gas space velocity in the intermediate tapered section 2 is within the range of 0.25 to 0.3 m/sec, about 50~75% of particles, having a particle size of 140 to 200 Mesh, in boiler calcine may be removed because those particles of 140 to 200 Mesh have a terminal velocity ranging from 0.3 m/sec to 0.6 m/sec, so that the amount of carried-over calcine may be reduced by about 10 to 15% based on the total calcine amount.

The reduction percentage of the carried-over calcine amount, that is, 10 to 15%, was calculated under the condition in which the amount of calcine removed from the boiler is estimated to be 40% based on the total amount of calcine removed from all subsequent processing facilities, as follows:

$$10\sim15\%=0.4\times0.5\times(0.5\sim0.7)$$

EXAMPLE 3

In accordance with the present invention, the tuyeres provided at the bed of the lower cylindrical section 3 of the roaster have a pitch of 85 to 95 mm, less than reduced from the pitch of 100 mm used in the conventional roaster, while having a diameter of 5 to 5.8 mm, so that they are arranged at a density of 110 to 135 per unit area. In accordance with such a tuyere arrangement, it is possible to enhance concentrate mixing and combustion effects while preventing the calcine from being locally sintered due to fine ore particles, and enabling an easy re-operation of the roaster. The following Table 5 shows specific gravity of calcine overflowed through the upper calcine discharge port 8 and unreacted concentrate, where the roaster having the above described tuyere arrangement is used.

TABLE 5

| Concentrate Particle Size of -325 Mesh | Apparent Specific Gravity of Overflow Calcine |
|---|---|
| 90% | 2.2 |
| 40% | 2.0 |

It is believed that the reason the concentrate having a smaller particle size exhibits an increased specific gravity after calcination thereof, as compared to the concentrate having a larger particle size, as shown in Table 5, is that the residence time of the calcine flowing at the bed is excessively long, so that impurities contained in the concentrate, for example, Pb, Cu, and SiO2, serve to increase the size of particles. Therefore, it is preferred that the roaster has the above defined tuyere diameter and tuyere pitch, in order to increase the flow rate of air through the tuyeres to a desired level for formation of an effective airflow.

That is, in accordance with the present invention, it is possible to enhance concentrate mixing and combustion effects while preventing the calcine from being locally sintered due to fine ore particles; and enabling an easy re-operation of the roaster, by designing the tuyeres, provided at the bed of the lower cylindrical section 3 of the roaster, to not only have a pitch of 85 to 95 mm, less than the pitch of 100 mm used in the conventional roaster, but also to have a diameter of 5 to 5.8 mm, less than the diameter of 6.0 mm used in the conventional roaster, so that they are arranged at a density of 110 to 135 pieces per unit area.

Where the tuyeres have a narrower pitch or a smaller diameter, they are likely to be clogged by calcine particles with the lapse of time. In this case, normal calcine flow conditions cannot be achieved. Accordingly, the tuyeres should be designed to meet the above defined conditions.

As apparent from the above described examples, in accordance with the present invention, the content of sulfide sulfur in zinc calcine is reduced about 0.25%, thereby enabling the real yield of Zn refining to be increased about 1%.

Thus, the fluidized bed roaster for zinc concentrate in accordance with the invention forms a stabilized fluidized bed capable of reducing the amount of calcine carried over to the upper gas discharge port, thereby reducing the maintenance costs. Also, there is a considerable working effect in that the number of working days is increased about 5 to 10%.

Taking into consideration the amount of calcine, roasted product, and the content of S.S in the calcine, compared to those obtained from a conventional roaster, it can also be found that the fluidized bed roaster according to the invention is effective to cut down the construction costs.

As apparent from the above description, the present invention provides a fluidized bed roaster for zinc concentrate which can refine zinc concentrate, thereby achieving an increase in the real yield of Zn refining. The fluidized bed roaster of the present invention can form a stabilized fluidized bed capable of reducing the amount of calcine carried over to a gas discharge port, thereby reducing the maintenance costs while providing a considerable working effect such as an increased number of working days.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A fluidized bed roaster for roasting zinc concentrate, comprising:

an upper cylindrical section closed at an upper end thereof by a top circular roof fixedly mounted to the upper end, the upper cylindrical section having a volume corresponding to 3.8 to 4.8 times the volume of a lower cylindrical section;

an intermediate tapered section fixedly coupled, at an upper end thereof, to a lower end of the upper cylindrical section, the intermediate tapered section having a structure downwardly tapered at a repose angle of 22 to 25° while having a volume corresponding to 1.7 to 2.2 times the volume of the lower cylindrical section;

the lower cylindrical section fixedly coupled, at an upper end thereof, to a lower end of the intermediate tapered section; and an air supply port coupled to a lower end of the lower cylindrical section, the air supply port having tuyeres arranged in a density of 110 to 135 tuyeres per square meter ($m^2$).

2. The fluidized bed roaster as set forth in claim 1, wherein the tuyeres have a diameter of 5 to 5.8 mm and a pitch of 85 to 95 mm.

* * * * *